US007017769B1

(12) United States Patent
Talmon

(10) Patent No.: US 7,017,769 B1
(45) Date of Patent: Mar. 28, 2006

(54) LID FOR CANNED BEVERAGES AVOIDING POLLUTION BOTH TO BEVERAGE AND ENVIRONMENT

(76) Inventor: Enrico Talmon, Via Pareda, 70, 38023 Canazei (IT)

( * ) Notice: Subject to any disclaimer, the term of this patent is extended or adjusted under 35 U.S.C. 154(b) by 0 days.

(21) Appl. No.: 10/018,241

(22) PCT Filed: Dec. 16, 1999

(86) PCT No.: PCT/IT99/00358

§ 371 (c)(1),
(2), (4) Date: Dec. 7, 2001

(87) PCT Pub. No.: WO00/47486

PCT Pub. Date: Aug. 17, 2000

(30) Foreign Application Priority Data

| | | |
|---|---|---|
| Feb. 12, 1999 | (IT) | TN99A0006 |
| May 11, 1999 | (IT) | TN99A0010 |
| Sep. 17, 1999 | (IT) | TN99A0015 |
| Nov. 4, 1999 | (IT) | MI99A2305 |

(51) Int. Cl.
*B65D 51/20* (2006.01)

(52) U.S. Cl. ..... 220/258.2; 220/906; 220/258.1; 220/258.3; 220/258.5; 220/796

(58) Field of Classification Search ..... 215/396, 215/309, 226; 220/906, 716, 718, 780, 793, 220/254.1, 256.1, 258.1, 258.2, 258.3, 258.5, 220/729–731, 713, 367.1, 366.1, 374, 373; 222/567, 570, 379, 710.5, 719
See application file for complete search history.

(56) References Cited

U.S. PATENT DOCUMENTS

| | | | | |
|---|---|---|---|---|
| 1,985,904 | A * | 1/1935 | Murch | 220/366.1 |
| 4,098,439 | A * | 7/1978 | Blow et al. | 222/570 |
| 4,679,702 | A * | 7/1987 | Maccarone et al. | 222/570 |
| 4,715,510 | A | 12/1987 | van der Muelen | |
| 4,790,444 | A * | 12/1988 | Terzi | 220/714 |
| 4,815,618 | A * | 3/1989 | Gach | 215/232 |
| 4,815,628 | A * | 3/1989 | Wehnert, III | 220/258.2 |
| 4,884,707 | A * | 12/1989 | Crisci | 215/256 |
| 4,917,258 | A | 4/1990 | Boyd | |
| 4,942,977 | A * | 7/1990 | Hidding | 220/276 |
| 5,054,640 | A * | 10/1991 | Tucker | 220/258.2 |
| 5,105,964 | A | 4/1992 | Heath | |
| 5,108,003 | A * | 4/1992 | Granofsky | 220/258.1 |
| 5,123,558 | A * | 6/1992 | Moloney | 220/258.2 |
| 5,139,163 | A | 8/1992 | Diaz | |
| 5,273,176 | A | 12/1993 | Diaz | |
| 5,931,332 | A * | 8/1999 | Mygatt et al. | 220/793 |
| 5,971,183 | A * | 10/1999 | Bartsch | 215/256 |

(Continued)

FOREIGN PATENT DOCUMENTS

| | | | |
|---|---|---|---|
| WO | 98 35883 | A | 8/1998 |

(Continued)

*Primary Examiner*—Robin A. Hylton
(74) *Attorney, Agent, or Firm*—Michael J. Striker

(57) ABSTRACT

A lid (30) of plastic material, applied by pressure, having a lateral handle (40), the purpose of the lid being to protect the top of the can (10) for drinks (28) against pollution, includes an opening (23) being made by a tear-off tongue (19), the lid matching substantially with the top of the can. The internal facing of the lid has a protuberance that acts as a stopper (45) and hermetically closes the aperture (28) in the can (10) when opened, thus avoiding accidental spillage of the drink (28) remaining in the can.

1 Claim, 3 Drawing Sheets

U.S. PATENT DOCUMENTS

| | | | | |
|---|---|---|---|---|
| 6,073,797 | A * | 6/2000 | Barous | 220/780 |
| 6,450,358 | B1 * | 9/2002 | Berro | 220/258.2 |
| 2002/0084241 | A1 * | 7/2002 | Yu-Hsien | 215/396 |

FOREIGN PATENT DOCUMENTS

| | | | |
|---|---|---|---|
| WO | 98 54058 | A | 12/1998 |

* cited by examiner

Fig. 7
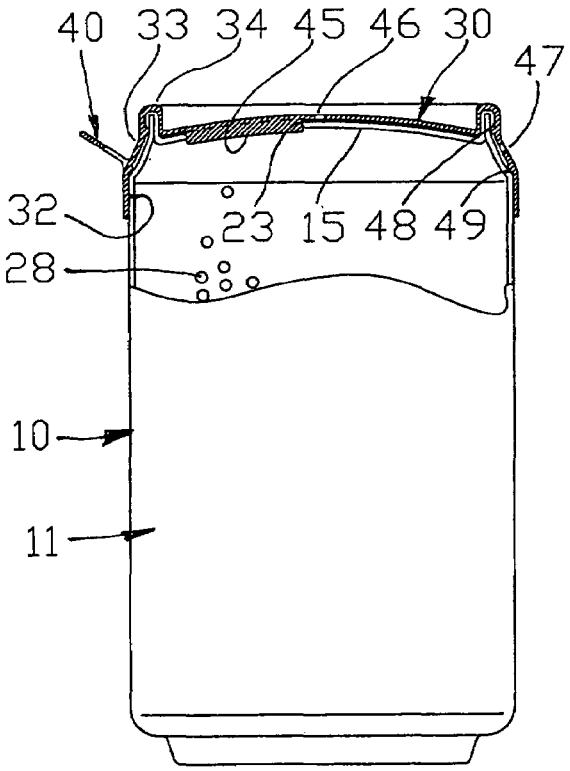
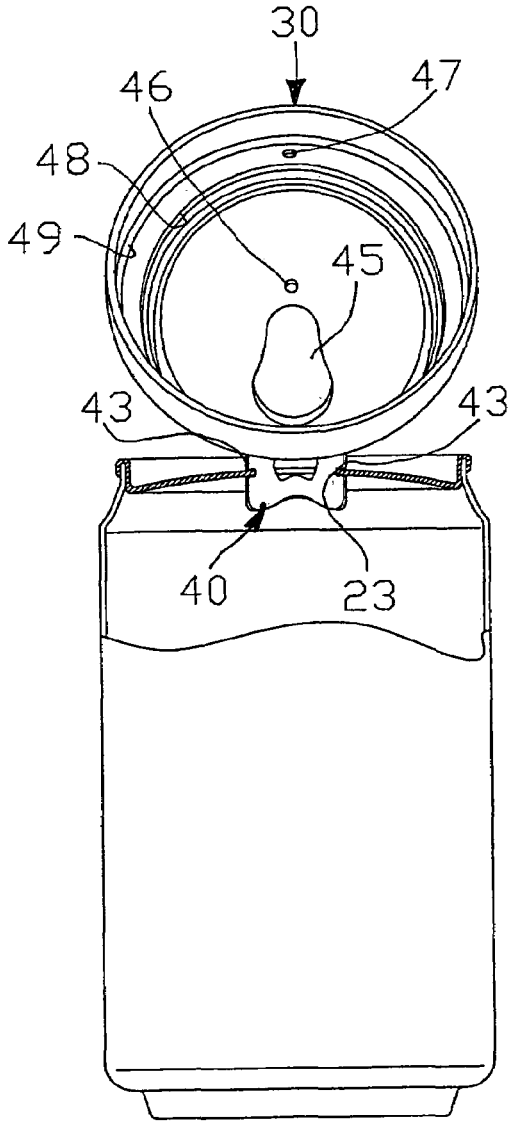
Fig. 9
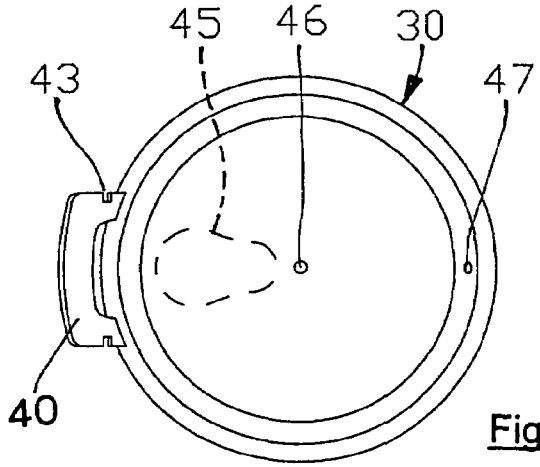
Fig. 8

LID FOR CANNED BEVERAGES AVOIDING POLLUTION BOTH TO BEVERAGE AND ENVIRONMENT

The invention concerns packaging of drinks in cans.

Cans containing drinks that can be drunk through an aperture made in the top surface of the can are in everyday use, the aperture being created by pulling off a strip prepared for the purpose, and by application of a ring fixed by a pin at the rear end of said strip, which ring, before being pulled up, lies flat on said top surface of the can.

The serious drawback connected with these cans is that there is nothing to protect the surface from dirt liable to accumulate during storage and transport.

Further, once open, there is no real way of closing the can which may means loss or, in any case deterioration, of any liquid not immediately drunk after opening the can.

The invention here described solves both these problems, that of dirt accumulating on the top surface and that of preserving the quality of the drink to be consumed later, as will now be explained. Subject of the invention is a lid applied by pressure to a can for drinks having a cylindrical body and truncated cone-shaped mouth at the closed top of a head round which is a raised edge, and an aperture which can be formed by pulling off a tongue-shaped strip. The shape and internal dimensions of said lid correspond to the shape and external dimensions of the top of the can to allow substantially reciprocal matching between the lid's truncated cone-shaped body and cylindrical mouth and the truncated cone-shaped mouth and cylindrical body of the can.

The base of said lid is concave presenting an external raised rim of a substantially U-shaped cross section, said rim matching with the raised edge round the upper surface of the can.

The height of the internal wall of the rim round the lid is substantially the same as that of the raised edge on the upper surface of the can.

The cylindrical mouth in the lid extends to match, for a few millimeters, with the cylindrical body of the can.

There is a protruberance on the base of the lid, shaped substantially like the aperture in the opened can, and slightly larger.

On applying the lid to the can so that the position of the protruberance corresponds radially to said aperture, said protruberance can therefore be pressed down inside the aperture, like a stopper, closing the can hermetically, avoiding any spillage of liquid, if not entirely drunk, and keeping the remainder unaltered for later consumption by simply removing the lid each time.

At the beginning and end of the truncated cone-shaped body of the lid are two annular sealing ribs that match with the beginning and end of the lid's truncated cone-shaped mouth.

Two vent holes (46, 47) are made in the lid substantially in the centre of its concave base and at the position of its truncated cone-shaped body between the two annular ribs.

A handle is situated on the outside of the lid, substantially at the meeting point between its truncated cone-shaped body and the cylindrical mouth; before use, this handle faces towards the top of the lid, lying flat against said lid's body, from where it can be easily rotated outwards for pulling the lid to detach it from the can.

Two lateral notches are cut into the handle about halfway along it, the transversal size of the handle being such that, when slightly bent longitudinally, it enters the aperture in the can, after all its contents have been drunk, until the edge of the aperture enters the notches fixing can and lid together to prevent them from falling apart and polluting the environment.

In one type of execution lid height is between 8 and 25 mm.

The lid is preferably made in one piece and of moderately elastic material whch may be plastic, rubber or some equivalent.

The invention offers evident advantages.

The top of the can is protected against pollution by means of a light and practically bulkless lid of negligible cost, the aperture for consumption of the drink being made in the top of the can by pulling off the tongue-shaped strip.

As the top of the can has a practically hermetic seal, the lid prevents pollution through accumulation of dirt and dust which, on opening the can, could fall into the drink making it unhealthy.

The presence of the lateral handle makes lifting the lid off in order to reach the contents an extremely simple and natural gesture.

As the lid can be put on again each time a drink is taken, any quantity left in the can is safe from pollution and its original high quality is fully maintained.

To sum up these advantages, a simple means of negligible cost not only protects the drink against pollutiion but also ensures that its full flavour and other characteristics remain unimpaired.

Characteristics and purposes of the disclosure will be made still clearer by the following examples of its execution illustrated by diagrammatically drawn figures.

Figure 1:
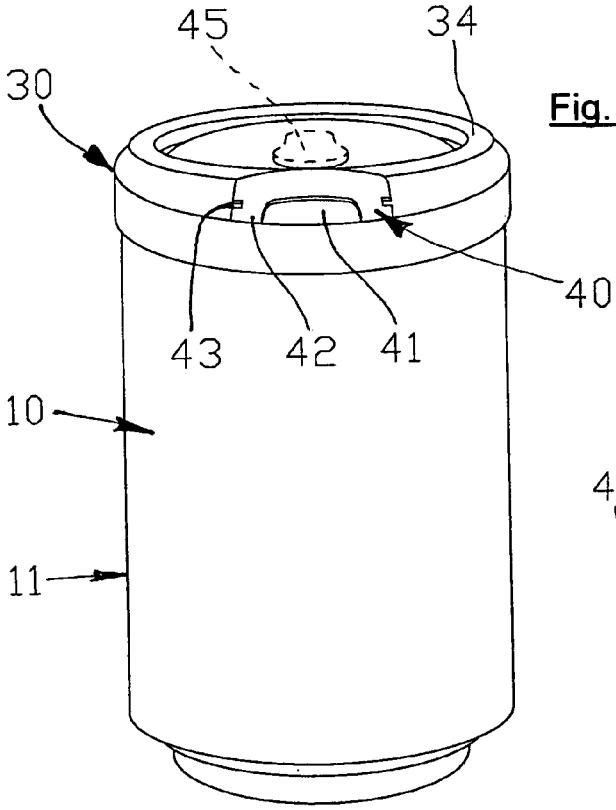
FIG. 1 shows a can of the known type, open, side view, partly cut away.
Figure 2:
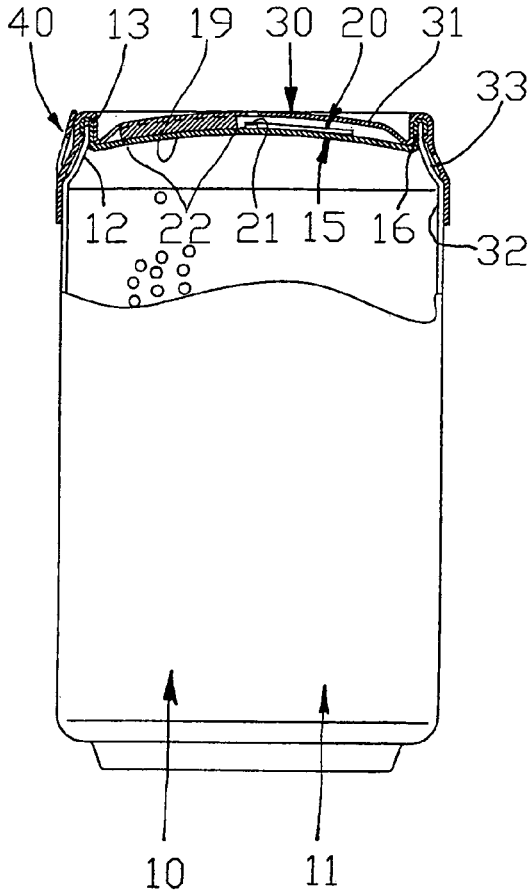
FIG. 2 shows the lid according to the present invention, cross section with enlarge detail.
Figure 3:
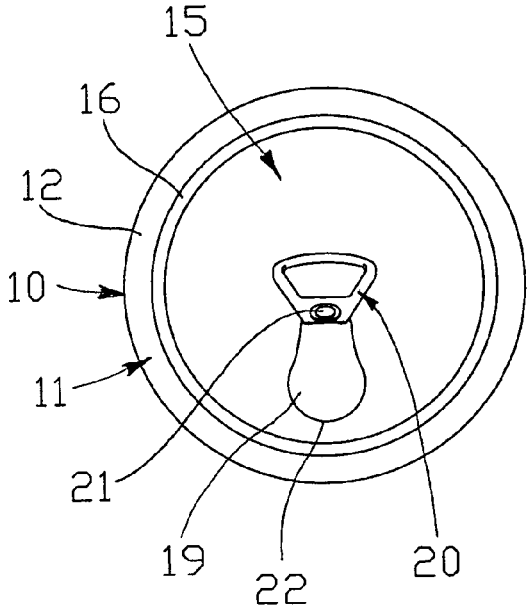
Figure 4:
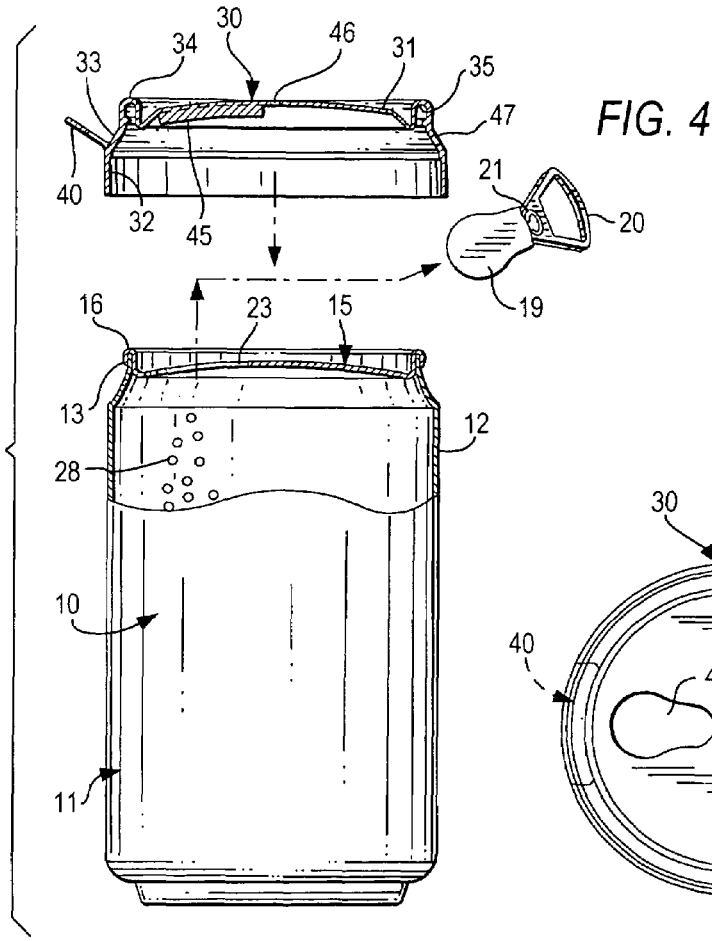

FIG. 2*a* Enlarged view of an upper part of the longitudinal section of FIG. 2, FIG. 3 is a plan view of the lid with outwardly inclined handle;

FIG. 4 is a can with the lid applied, in longitudinal section with enlarged detail;

FIG. 4*a* Enlarged view of an upper part of the longitudinal section of FIG. 4.

Figure 6:
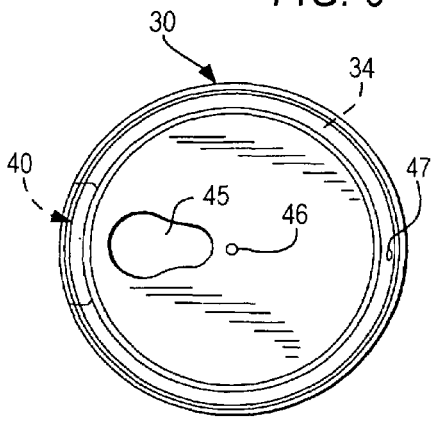
Figure 5:
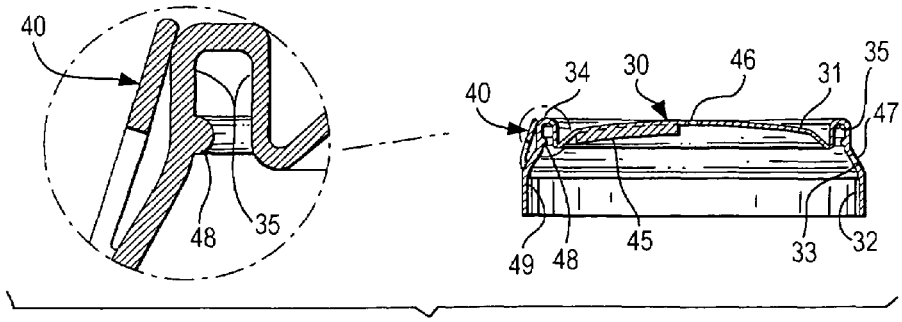

FIG. 5 is the can with the lid applied, in perspective view;

FIG. 6 is the can open and emptied, with lid handle engaged in the opening, in perspective view;

FIG. 7 is the can open, with the lid handle on, in longitudinal section;

FIG. 8 is a plan view of the can when open, with a lid on, of FIG. 7; and FIG. 9 is the can open with the lid handle fitted into the aperture, after emptying.

The can 10 of the known type, open comprises the cylindrical body 11 and truncated-cone shaped mouth 12 with rim 13, closed by the top 15. The aperture 23 with edges 24 is visible, the aperture being made by pulling the prepared tear-off part, as in well-known types.

The lid 30 of plastic material, subject of the invention, presents shape and internal dimensions which, when subjected to slight elastic pressure, correspond to the top of the can, and comprise the cylindrical mouth 32 connected by the truncated-cone shaped body 33 to a channel 35 shaped like an overturned "U" with convex base 31.

Inside the lid there is a first annular rib 48 situated substantially at the top of the truncated-cone shaped body 33.

A second annular rib 49 is present substantially in the area between the truncated-cone shaped body 33 of the lid and its cylindrical mouth 32. Fixed onto the lid 30 is a handle 40 to facilitate detachment from the can when required, there being in the handle a central hole 41 and notches 43 in the lateral edges.

The length between the bases of the notches is slightly greater than the width of the opening made when pulling off the top of the can.

The handle, which, when not in use, lies close to the truncated-cone shaped body 33 of the lid, can be rotated outward, as shown in FIG. 3, to facilitate the pulling action exerted on the lid.

FIGS. 4 and 5 show how the lid 30 is applied to the can 10.

It will therefore be seen that the truncated-cone shaped body 33 of the lid 30 matches with the truncated-cone shaped mouth 12 of the can 10 by means of the annular sealing ribs 48 and 49, and by matching between the cylindrical mouth 32 of the lid 30 and the cylindrical body 11 of the can 10.

The rib 48 at the top of the can prevents leakage of any remaining beverage, while the rib 49, close to the cylindrical body of the can, hinders penetration of any polluting substances from the outside.

FIG. 6 illustrates forced insertion of the moderately elastic handle 40 inside the aperture 30 in the top of the can when the beverage 28 has been consumed. The stable connection thus formed between can and lid prevents the latter from being discarded and so polluting the environment.

As the above invention has been described and explained as one example only and to show its essential features, many variations may be made to it according to industrial, commercial and other requirements, or be included in other systems and means without departing from its sphere of operation.

It is therefore understood that the application to patent comprises any equivalent application of the concepts therein expressed or any equivalent product executed and/or operating according to any one or more of the following claims.

What is claimed is:

1. A pressure applied lid for beverages in cans having a cylindrical body with a truncated cone-shaped top closed by a head in which an opening is created by a tear-off tongue, a truncated cone-shaped body and a cylindrical mouth whose internal shape and dimensions substantially correspond to the external shape and dimensions of the truncated cone-shaped top of the cylindrical body of the can, the lid being formed as a single piece and including two annular sealing ribs with one rib provided on a top of the truncated cone-shaped body to engage with a raised rim of the head and to create a seal to prevent loss of a remaining beverage, and the other rib provided at a base of the truncated cone-shaped body to prevent pollution of a top of the can; and a substantially rectangular handle that departing from a base of the lid extends upwards and is provided on each side with two notches at a substantially same height and open toward an outside of said handle so that a distance between bottoms of said notches is somewhat greater than a maximum width of an area prepared for tear-off in heads of cans for beverages to create an aperture by pulling on a tab, so that when a beverage has been consumed and the lid has been removed, a slight pressure forces said handle of the lid into the aperture of the can, causing edges of the aperture to penetrate into said notches fixing the can and the lid together, and thereby preventing dispersal of the lid in an environment and consequent pollution.

* * * * *